United States Patent [19]

Kobori et al.

[11] Patent Number: 5,022,201

[45] Date of Patent: Jun. 11, 1991

[54] APPARATUS FOR ACCELERATING RESPONSE TIME OF ACTIVE MASS DAMPER EARTHQUAKE ATTENUATOR

[75] Inventors: Takuji Kobori; Mitsuo Sakamoto; Toshikazu Yamada; Isao Nishimura, all of Tokyo; Koji Ishii; Jun Tagami, both of Chofu, all of Japan

[73] Assignee: Kajima Corporation, Tokyo, Japan

[21] Appl. No.: 343,085

[22] Filed: Apr. 25, 1989

[30] Foreign Application Priority Data

| | | | |
|---|---|---|---|
| Apr. 26, 1988 | [JP] | Japan | 63-102940 |
| Apr. 26, 1988 | [JP] | Japan | 63-102941 |
| Apr. 26, 1988 | [JP] | Japan | 63-102942 |
| Apr. 26, 1988 | [JP] | Japan | 63-102943 |

[51] Int. Cl.[5] ..... E04H 9/02

[52] U.S. Cl. ..... 52/167 DF

[58] Field of Search ..... 52/167, 167 DF

[56] References Cited

U.S. PATENT DOCUMENTS

| | | | |
|---|---|---|---|
| 3,940,895 | 3/1976 | Yamamoto et al. | 52/167 |
| 4,793,105 | 12/1988 | Caspe | 52/167 DF |
| 4,799,339 | 1/1989 | Kobori et al. | 52/167 DF |
| 4,841,685 | 6/1989 | Masri et al. | 52/167 DF |

FOREIGN PATENT DOCUMENTS

| | | | |
|---|---|---|---|
| 59-97341 | 6/1984 | Japan | 52/167 DF |

OTHER PUBLICATIONS

J. N. Yang, "Optimal Control Theory to Civil Engineering Structures," *Journal of the engineering Mechanics Division,* vol. 101, No. EM6, Dec. 1975, pp. 819–838.

James C. H. Chang and Tsu T. Soong, "Structural Control Using Active Tuned Mass Dampers," *Journal of the Engineering Mechanics Division,* vol. 106, No. EM6, Dec., 1980, pp. 1091–1098.

J. N. Yang, "Control of Tall Buildings under Earthquake Excitation," *Journal of the Engineering Mechanics Division,* vol. 108, No. EM5, Oct., 1982, pp. 833–849.

*Primary Examiner*—Richard E. Chilcot, Jr.
*Assistant Examiner*—Michele A. Van Patten
*Attorney, Agent, or Firm*—James H. Tilberry

[57] ABSTRACT

A positive vibration suppression apparatus is disclosed, which suppresses vibrations of a building caused by earthquakes or winds by applying a control force to the building. The apparatus comprises a weight provided on the top of the building in a suspended form to reduce friction and an actuator provided between the weight and the building. The vibration suppression apparatus is controlled through sensing of the vibrations of the building and weight by a sensor, whereas for excessive vibrations of the building the vibrations of the weight are made close to the vibrations of the building to protect the apparatus, because the capacity of the vibration suppression apparatus is limited. Further, in an oil hydraulic system for obtaining a great control force, small and large size oil hydraulic pumps connected to respective small and large size electric motors and an accumulator are provided in parallel, so that the apparatus is warmed up at all time for oil hydraulic control with low power consumption. Two or more vibration suppression apparatuses are controlled at the same time according to the shape of the building to cope with torsional and secondary vibration components.

25 Claims, 5 Drawing Sheets

APPARATUS FOR ACCELERATING RESPONSE TIME OF ACTIVE MASS DAMPER EARTHQUAKE ATTENUATOR

BACKGROUND OF THE INVENTION

1. Field of the Invention

This invention relates to an apparatus for positively suppressing vibrations of building structures caused by such external forces as earthquakes and winds.

2. Description of the prior art

The present inventors have been invented an apparatus for positively suppressing vibrations of a building, which comprises an additional mass and an actuator and is provided on the top or the like of the building to apply, when the building experiences external forces of an earthquake or winds, a force tending to suppress the vibrations to the building from the reaction force of a weight as the additional mass produced through control of the operation of the actuator (as disclosed in Japanese Patent Laid-open Publications Nos. 62-268478 and 63-78974).

FIG. 1 illustrates the outline of the positive vibration suppression apparatus. On the top of a building 1, for example, a weight 2 is provided as an additional mass such that it is substantially separated from the building 1, and an actuator 3 is interposed between the weight 2 and a portion of the building 1. When vibrations of the building 1 are produced by an earthquake or winds, a sensor 4*a* provided in the building 1 senses the vibrations and provides a signal to a control circuit, which in turn supplies an output signal corresponding to the vibrations to a servo valve connected to the actuator 3 to control the actuator 3. Further, another sensor 4*b* may be provided on the side of the actuator 3 to effect feedback control of the movement of the actuator 3. While the above control is based on a closed loop control, it is also possible to measure a response of the building through analysis of earthquake waves supplied from wide and narrow bandwidth seismometers and combine the result of the analysis with an opened loop control.

However, a delay with respect to the signal in the operation time is produced in a mechanical part of the apparatus. Such a time delay should be reduced.

Further, earthquakes and winds are natural phenomena, and their scales can not be forecast when designing the apparatus. Therefore, where the maximum performance of the apparatus is determined with respect to frequently occurring medium scale earthquakes and typhoons with wind velocities of 15 m/sec. or less, it is necessary to prevent an excessive load above the capacity of the apparatus from being applied to the apparatus at the time of occurrence of a large scale earthquake. Thus, it is necessary to suppress a control force with respect to vibrations when large scale vibrations of the building take place.

Further, nobody can tell when an earthquake takes place, and the apparatus should be rendered operative as soon as an earthquake occurs. Further, it takes time until a steady operation state of an oil hydraulic system sets in after the start. This means that it is necessary to have the system warmed up by starting it to be ready for the occurrence of an earthquake at all time. For this reason, the system requires extreme running expenditures such as electric power expenditures. In addition, the life of the system is not so long.

Further, strong winds do not appear at all time, so that a large capacity electric motor need not be held operative at all time.

Further, the weight 2, which is made of steel with a mass of about 1/100 of the weight of the building, should be such that a force of the actuator 3 is smoothly transmitted to the weight. Further, the installation space is desirably as small as possible.

Further, the actuator 3 desirably operates at a comparatively high speed and has a large capacity, and is desirably constituted by an oil hydraulic cylinder or the like to realize a large stroke apparatus. In this case, it is important to secure the oil hydraulic cylinder installation space inclusive of the space for the stroke.

Further, since the weight 2 has a considerably large mass, it is necessary to reduce the influence of frictional forces as much as possible to obtain efficient and reliable vibration suppression.

Where an oil hydraulic cylinder is used for the actuator 3, the direction of control is limited, that is, it is impossible to suppress the vibrations of the building in certain directions although the vibrations in other directions can be suppressed.

Depending on the design of the building, it is usually possible to obtain a comparatively large effect through control only in one direction. However, externally applied forces due to earthquakes and winds are uncertain forces, and, in an eccentric building or the like, further effective vibration suppression can be obtained by suppressing the torsional component of vibrations.

Further, in high story or ultra-high story buildings, the secondary vibration component is often large. Therefore, it is possible to improve the vibration suppression effect by suppressing the secondary vibration component.

SUMMARY OF THE INVENTION

A positive vibration suppression apparatus according to the present invention basically provides a control force converse to vibrating force and proportional to the speed of vibrations. More specifically, a signal from vibration sensor means provided on or in a building is amplified by an amplifier to obtain a control signal to control an actuator, and a reaction force of a weight in the actuator is applied as the control force to the building to suppress vibration thereof.

According to one aspect of the invention, the building and weight are provided with respective vibration sensor means for sensing their vibrations, and amplifying circuits are provided in parallel to amplify response signals from the respective vibration sensor means. Mechanical delay can be compensated for by providing phase control means in the amplifying circuits. The phase control means includes an integrating circuit to cause a phase shift of 90 degrees so that it can control a phase within a range of 0 to 90 degrees. It is thus possible to control the phase (within a range of $\pm 180$ degrees) according to the delay in mechanical part. Further, the amplifying circuit for amplifying the response signal from the building side vibration sensor means is provided with an automatic gain control circuit for controlling the signal level. Further, another automatic gain control circuit is provided for controlling the output level of a resultant signal obtained from the two amplifying circuits on the building side and on the weight side.

If acceleration gauges are used as vibration sensor means, it is possible to sense very small vibrations and higher order vibrations. In this case, the phase delay can be reasily compensated for to permit phase control of the actuator with in cooperation with the phase control means noted above.

As shown above, according to the invention it is possible to compensate for the mechanical time delay by the provision of phase control means in the amplifying circuits. Further, it is possible to control the level of a signal when combining the building side response signal with the amplified weight side response signal by providing the automatic gain control circuit in the amplifying circuit for amplifying the building side response signal. Thus, when vibrations of the building are not so great, it is possible to obtain control according to the amplitude of vibrations for the amplification factor for the building side response signal is large. When the vibrations of the building are increased, the amplification factor of the building side response signal is reduced, and the factor of contribution of the movement on the weight side to the control is increased. At any rate, the vibration suppression apparatus effects control in a fixed capacity range irrespective of vibrations of the building. Therefore, while the vibrations are great, the weight is moved substantially in unison with the building (i.e., it is substantially stationary with respect to the building) and does not receive any substantial large force, and the safety of the apparatus can be ensured. When the vibrations of the building are reduced with attenuation of an earthquake, the amplification factor for the building side response signal is increased by the action of the automatic gain control circuit, so that it is possible to obtain control for effectively suppressing the vibrations of the building. Further, with respect to the output of the resultant signal the output level thereof is further amplified by the automatic gain control circuit. Therefore, the vibration suppression apparatus will not excessively operate for excessive vibrations of the building. In other words, vibrations of the building in excess of the capacity of the vibration suppression apparatus are controlled within the capacity of the vibration suppression apparatus, and with respect to greater vibrations the relative movements of the weight and building are reduced, thus ensuring the safety of the apparatus.

It is possible to greatly extend the scope of application by permitting the vibrations of the building to be suppressed by combining the vibration suppression apparatus with vibration-proof structure, vibration absorbers and other vibration suppression apparatuses.

As an oil hydraulic pressure source of the positive vibration suppression apparatus, a small size oil hydraulic pump connected to a small size electric motor, a large size oil hydraulic pump connected to a large size electric motor and a large capacity accumulator are provided in parallel. Normally, only the small size electric motor is held operative to store oil hydraulic pressure in the accumulator by using the small size oil hydraulic pump as the oil hydraulic pressure source to hold the apparatus in a warmed-up state at all time. In an initial stage of an earthquake, necessary oil hydraulic pressure is supplied from the accumulator provided in parallel with the oil hydraulic pump. During this time, the large size electric motor is started to operate the large size oil hydraulic pump for supplying necessary oil hydraulic pressure in a final stage of the earthquake. Thus, an economical and stable oil hydraulic pressure source can be provided.

When an earthquake occurs, the large size electric motor is started by an electric signal transmitted from the control circuit of the positive vibration suppression apparatus to operate the large size oil hydraulic pump to effect warming-up of the apparatus while the accumulator is supplying oil hydraulic pressure necessary for the initial stage of the earthquake. The large size oil hydraulic pump commences supply of the oil hydraulic pressure by the time, when the pressure of the accumulator turns to be reduced. When strong winds are produced, the large size electric motor is started by an electric signal transmitted from the control circuit of the positive vibration suppression apparatus to operate the large size oil hydraulic pump as oil hydraulic pressure source, thereby enabling the operation of the apparatus. The large size pump is adapted to be supplied with pressure load when and only when it is required to do so through a pressure regulator valve or the like which is operable by pressure sensor means such as a pressure switch for sensing reduction of the oil hydraulic pressure of the accumulator, so that power of the motor can be consumed without waste.

In a different aspect of the invention, an oil hydraulic cylinder, with which a large stroke can be comparatively easily obtained, is used as the actuator, and the center of the oil hydraulic cylinder is supported by a pin on the gravitational axis of the weight via a center trunion or the like. The piston of the oil hydraulic cylinder has its free end in pin contact with a securing section of the building through a clevis or the like. Since the weight of the oil hydraulic cylinder is set on the weight, there is no need of securing an installation space of the oil hydraulic cylinder separately from the weight, so that the entire length of the mechanical part of the vibration suppression apparatus can be reduced. Further, since the center of the oil hydraulic cylinder is supported by a pin at a position on the gravitational axis of the weight, smooth transmission of force can be obtained compared to the case where the center of the oil hydraulic cylinder is connected to an end of the weight. Further, since the free end of the oil hydraulic cylinder is in pin contact, when the weight is suspended as will be described later, it is possible to absorb the vertical movement of the weight produced with horizontal movement thereof to permit stable transmission of force.

Further, by forming the weight such as to have a shape having a channel-shaped profile of a section perpendicular to the axial direction of the oil hydraulic cylinder, it is possible to arrange such that the axis of the oil hydraulic cylinder passes through the centroid of the weight, thus permitting smooth transmission of the force. The weight has a mass of about 1/100 of the mass of the building, and it is suitably made of such metal as steel or lead from the consideration of the space factor.

In order to minimize the mechanical time delay by causing momentary operation of the vibration suppression apparatus with respect to earthquake vibrations, it is necessary to reduce the friction in the mechanical part of the apparatus as much as possible. To this end, it is desired to suspend the weight via a hanging member such as wires. For installation, a steel frame is built on the top of or in the building, and the weight is suspended from the frame via the hanging member. The handing member suitably used includes wire ropes, PC steel wires or piano wires, and the weight is preferably suspended at a plurality of points, for instance, four or eight points, to remove the rotation of the weight. Further, it is desired to use pulleys as much as possible to preclude the influence of frictional force of the support.

Further, compared to a method for supporting the weight with a roller or a method for causing the weight to roll along guide rails, the influence of the friction can be extremely minimized, and also even very small vibrations can be controlled. Further, buffers may be applied to the underside of the weight to cope with an accident in case where the weight is suspended. Further, it is desired to provide a guide to avoid torsional vibrations of the weight.

In a further aspect of the invention, a plurality of vibration suppression apparatuses as above are provided on or in the building to be controlled to suppress complicated vibrations of the building by simultaneously controlling the plurality of vibration suppression apparatuses. These vibration suppression apparatuses may utilize a common oil hydraulic pressure source to simplify the equipment.

More specifically, it is possible to obtain control conforming to the plane shape of building through control of vibrations in perpendicular directions with two vibration suppression apparatuses (see FIG. 5). Further, when it is intended to control vibrations in a particular direction, a main vibration suppression apparatus is installed at the center of the plane of the building, and an auxiliary vibration suppression apparatus is installed at an end of the plane of the building such that it extends in the same direction as the main vibration suppression apparatus for controlling the torsional component of vibrations of the building (see FIG. 6). Further, for a high story or ultra-high story building an auxiliary vibration suppression apparatus may be provided on a floor constituting the node of secondary vibration mode in addition to a main vibration suppression apparatus provided on the top of the building for simultaneously controlling the two apparatuses to control the secondary vibration component of the building with the auxiliary vibration suppression apparatus (see FIG. 7).

OBJECTS OF THE INVENTION

An object of the present invention is to provide an apparatus for positively suppressing vibrations of building structures, in which a control signal generating circuit for controlling the operation of an actuator such as an oil hydraulic cylinder is provided with phase control means to permit compensation of mechanical time delay with respect to the operation of the actuator.

Another object of the invention is to provide, in case where the maximum performance of the vibration suppression apparatus is determined in consideration of frequently occurring medium scale earthquakes as a subject, an amplifying circuit for amplifying a building side response signal with an automatic gain control circuit, for preventing excessive operation of the apparatus at the time of occurrence of large scale earthquakes to maintain the safety of the apparatus.

A further object of the invention is to provide an economical vibration suppression apparatus, in which an oil hydraulic apparatus for generating great control force is combined with an electric control circuit to effectively suppress vibrations of a building, and also a small size electric motor and a small size pump which are operated at all time are combined with a large size electric motor and a large size pump when and only when effecting control with respect to an earthquake or winds, so that the apparatus can be held warmed up at all time and can immediate start oil hydraulic control, permit control without application of any great load at the time of rise of the large size electric motor, consumes low power, requires low running cost and obtain a long-life and economical vibration suppression apparatus.

A further object of the invention is to provide a vibration suppression apparatus, which has a compact construction and permits smooth transmission of force with the point of application of force of an oil hydraulic cylinder and centroid of the weight coincident.

A still further object of the invention is to provide a vibration suppression apparatus, in which the weight is suspended to reduce influence of friction, eliminate rotation of the suspended weight and permit effective control.

A yet further object of the invention is to provide a vibration suppression apparatus, which is simple in the construction of the mechanical part and can be installed in the existing building.

A yet further object of the invention is to provide a method for suppressing vibrations, in which a plurality of vibration suppression apparatuses are controlled at the same time to permit control of vibrations in two perpendicular directions, control of torsional vibration component and control of secondary vibration component.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 2:
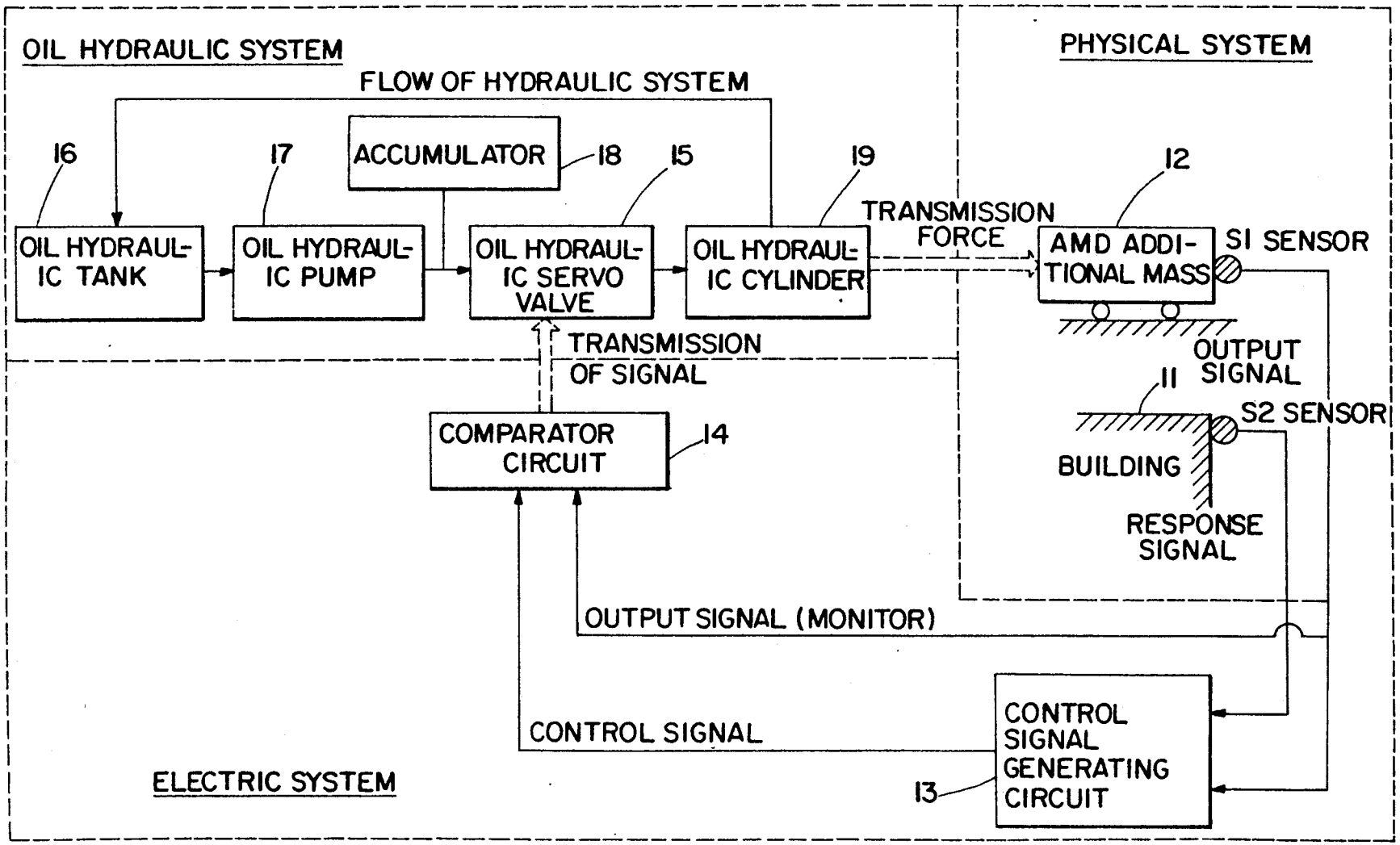
FIG. 2 is a view showing an oil hydraulic system of the positive vibration suppression apparatus.

FIG. 2 is a schematic block diagram showing an oil hydraulic system of a positive vibration suppression apparatus according to the present invention. Acceleration gauges S1 and S2 are provided as vibration sensors on an active mass driver (AMD) 12 of the vibration suppression apparatus and a building 11, and a response signal is supplied to a control signal generating circuit 13.

The control signal generating circuit 13 effects phase control and amplification of the inputs as will be later described to produce a control signal which is supplied to a comparing circuit 14. Meanwhile, the sensor S1 which senses the movement of the AMD 12 also provides an output signal to the comparing circuit 14 for feedback control. The comparing circuit 14 supplies a control signal to an oil hydraulic servo valve 15 provided on an oil hydraulic cylinder 19 to control the oil hydraulic servo valve 15. The oil hydraulic system has a loop constituted by an oil hydraulic tank 16, an oil hydraulic pump 17, an oil hydraulic servo valve 15 and an oil hydraulic cylinder 19, and an accumulator 18 is provided between the oil hydraulic pump 17 and the oil hydraulic servo valve 15.

The oil hydraulic cylinder 19 can be operated under control by the oil hydraulic servo valve 15 to obtain a reaction force from the building 11 so as to apply a force tending to suppress vibrations of the building 11 to the AMD 12 of the vibration suppression apparatus.

Figure 3:
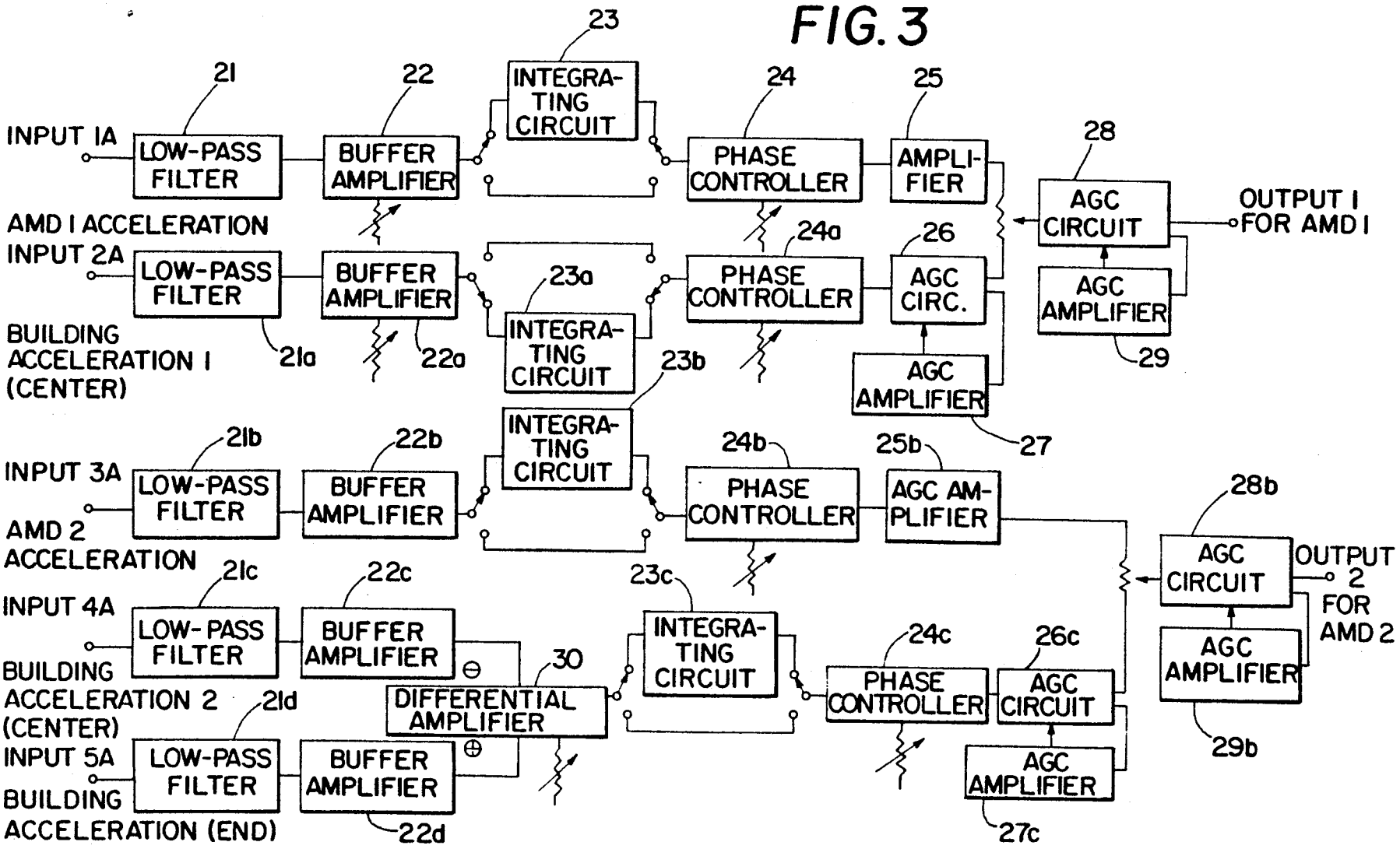
FIG. 3 is a block diagram showing a signal generating circuit of the positive vibration suppression apparatus according to the present invention.

FIG. 3 is a block diagram showing the control signal generating circuit.

In this embodiment, as shown in FIG. 3 to be described later, in addition to a main vibration suppression apparatus (shown at AMD1 in the drawing), an auxiliary vibration suppression apparatus (AMD2) is installed at an end of the building to control the torsional component of vibrations. In FIG. 3, an input 1 represents the acceleration of a weight of the main vibration suppression apparatus installed at the top center of the building as sensed by the sensor S1 shown in FIG. 6, inputs 2 and 4 represent the acceleration of the top center of the building as sensed by the sensor S2, and input 3 represents the acceleration of a weight of the auxiliary vibration suppression apparatus AMD2 installed at an end of the top of the building as sensed by the sensor S3, and an input 5 represents the acceleration of an end of the top of the building as sensed by the sensor S4.

The input 1 is passed through a low-pass filter 21 to remove very small vibration components and noise components, then amplified by a buffer amplifier 22 and then supplied through an integrating circuit 23 and also directly to a phase controller 24. Since the input 1 represents the acceleration, it is 90 degrees out of phase with respect to the velocity and also contains a mechanical time delay introduced in the mechanical part such as the oil hydraulic cylinder 19 (see FIGS. 2 and 8 to 10). Therefore, if necessary, it is subjected to 90-degree phase adjustment in the integrating circuit 23 and then to a phase control in a range of 0 to 90 degrees in the phase controller 24. Subsequently, its signal level is adjusted in an amplifier 25.

The input 2 likewise is subjected to removal of very small vibration components and noise components, then subjected to phase control and then passed through an automatic gain control circuit 26, thereby controlling its signal level to a preset level. The control signal is 90 degrees out of phase with respect to the phase of vibrations of the building.

The inputs 1 and 2 are combined through parallel amplifiers as noted above.

The driving of the weight 21 of the vibration suppression apparatus should be done within the capacity thereof, and the amplitude is limited, whereas there is a large acceleration range of the vibrations of the building 11 depending on the scale of earthquake. Therefore, an automatic gain control circuit (AGC) 26 is provided on the side of the building, so that the amplication factor of the building side circuit is high when the building side acceleration is low while it is low when the building side acceleration is high. Thus, while control 90 degrees out of phase with respect to vibrations of the building 11 is done according to the vibrations with a low building side acceleration, with increase of the building side acceleration the oil hydraulic cylinder 19 is no longer operative so that the weight 12 is just like stationary with respect to the building 11. With reduction of the building side acceleration the amplification factor of the building side circuit is increased again to reduce the period of attenuation of vibrations of the building 11.

The resultant signal obtained from the parallel amplifiers is also passed through a gain control circuit (AGC) 28 to obtain a preset signal level for controlling the movement of the weight 12 within the capacity of the apparatus.

The input 3, which represents the acceleration of the weight of the auxiliary vibration suppression apparatus AMD2, is controlled in an amplifier like the input 1 noted above. The inputs 4 and 5, which represent the accelerations of the center and end of the building, respectively, are passed through respective low-pass filters **21*c* and 21*d* and buffer amplifiers 22*c* and 22*d* before being supplied to a differential amplifier 30 to obtain their difference. The torsional vibration component is subjected to the same control as with the input 2 before being combined with the input 3 passed through the amplifier, and the resultant signal is passed through an automatic gain control circuit 28*b*** to obtain a control signal with respect to the weight of the auxiliary vibration suppression apparatus AMD2.

Figure 4:
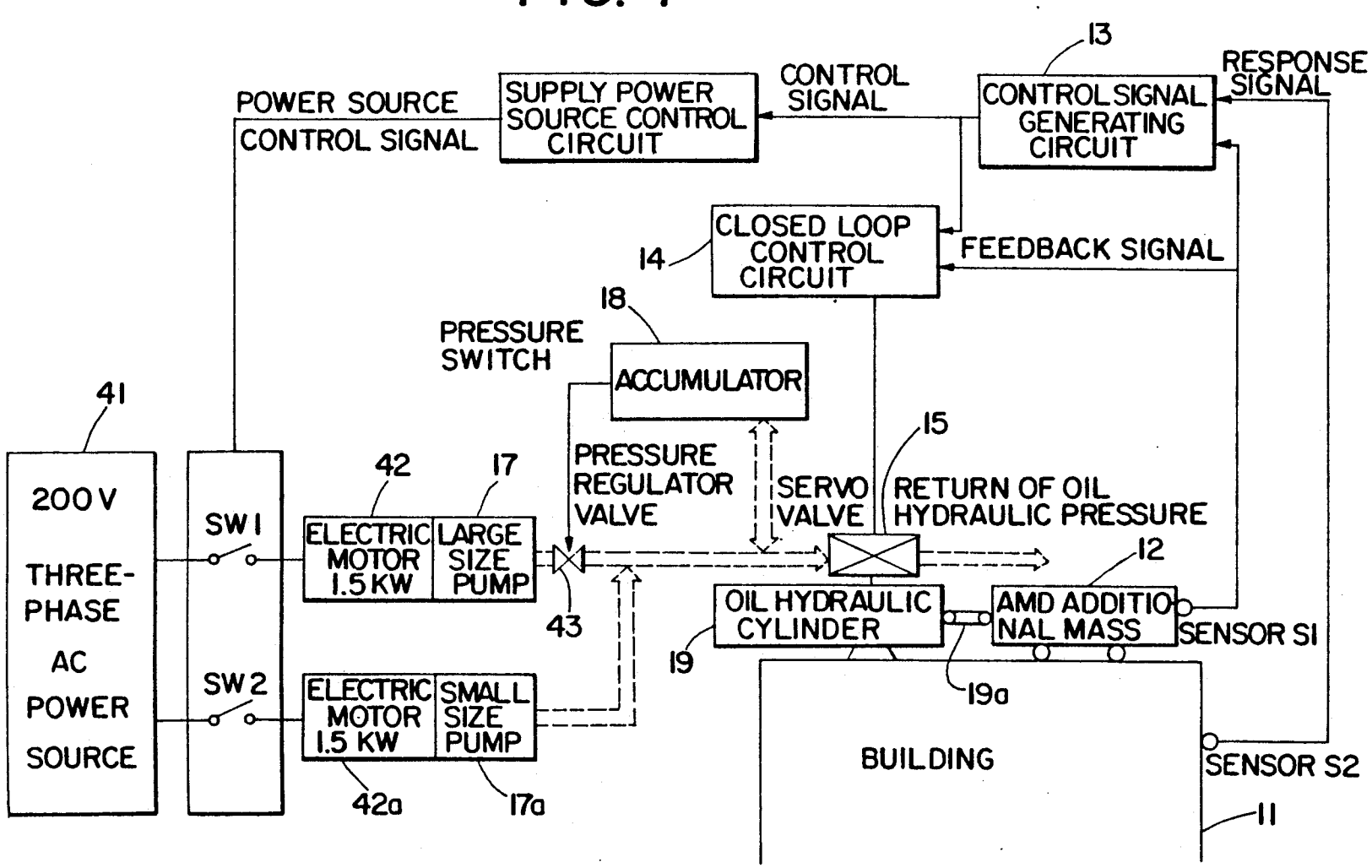
FIG. 4 is a block diagram showing an oil hydraulic system of the positive vibration suppression apparatus.

FIG. 4 is a block diagram showing a single-system positive vibration suppression apparatus incorporating an oil hydraulic system according to the present invention. It uses a 4-ton weight 12 to suppress vibrations of a 400-ton building 11.

In this embodiments, a 200-V three-phase AC power source 41 is used to hold a 1.5-kW small size electric motor **42*a* operative at all time. Thus, a servo valve 15 is held in a controlled state at all time to continuously supply operating fluid at a rate of 2 to 3 liters per minute so that the apparatus is warmed up at all time. Further, an oil pressure is stored in the accumulator 18 (80 liters) by the 1.5-kW small size electric motor 42*a* and a small size pump 17*a* connected thereto, and operating fluid necessary in an initial stage of an earthquake is supplied from this accumulator. Thus, a satisfactory initial control state can be obtained. Further, when the oil pressure in the accumulator 18 is reduced with the start of the 15-kW large size electric motor 42 at the time of occurrence of an earthquake, the operating fluid is supplied from the large size pump 17 connected to the 15-kW large size motor 42**.

The accumulator 18 is provided with a pressure switch as pressure sensor means. When the pressure rises at the time of the start of control, a pressure control valve 43 is controlled to cause circulation of oil between the large size pump 17 and the tank 16 (see FIG. 2) so as to keep the load on the 15-kW large size electric motor minimum. When the oil hydraulic pressure is reduced to a predetermined pressure, the pressure regulator valve 43 is opened to the side of the oil hydraulic control circuit to control the pressure of operating fluid flowing from the large size pump 17 connected to the 15-kW large size electric motor 42. Thus, the load on the 15-kW large size electric motor is controlled to save power consumed by the motor. The 15-kW large size electric motor 42 is held warmed up in an idling state with a small load while the operating fluid is circulated between the large size pump 17 and the tank 16.

The vibration suppression apparatus described above effects vibration suppression as follows.

The sensor 2 senses vibrations of the building 11 and supplies a response signal to the control signal generating circuit 13. The control signal generating circuit 13 provides a control signal to the servo valve 15 and power source 14 to start control of the hydraulic pressure and servo valve 15. At the same time, the switch SW1 of the large size electric motor 42 is closed.

Meanwhile, the sensor S1 senses the movement of the weight 12 as additional mass with the operation of the oil hydraulic cylinder 19 and supplies a response signal to the control signal generating circuit 13. Weight 12 may be connected to hydraulic cylinder 19 by any conventional rigid coupling means 19*a*.

As the principles of the vibration suppression, the vibrations of the building body 11 can be controlled by applying a force tending to cause converse vibrations. In this case, the control circuit 13 controls the phase of mechanical time delay due to friction and other causes and supplies a control signal to the servo valve 15. Further, error correction is effected by feeding back the movement of the weight 12.

When the vibration control is started, the pressure regulator valve 43 senses a pressure reduction in about 5 seconds, for instance, and the oil hydraulic control is continued through control of the load of the large size electric motor 42.

Figure 8:
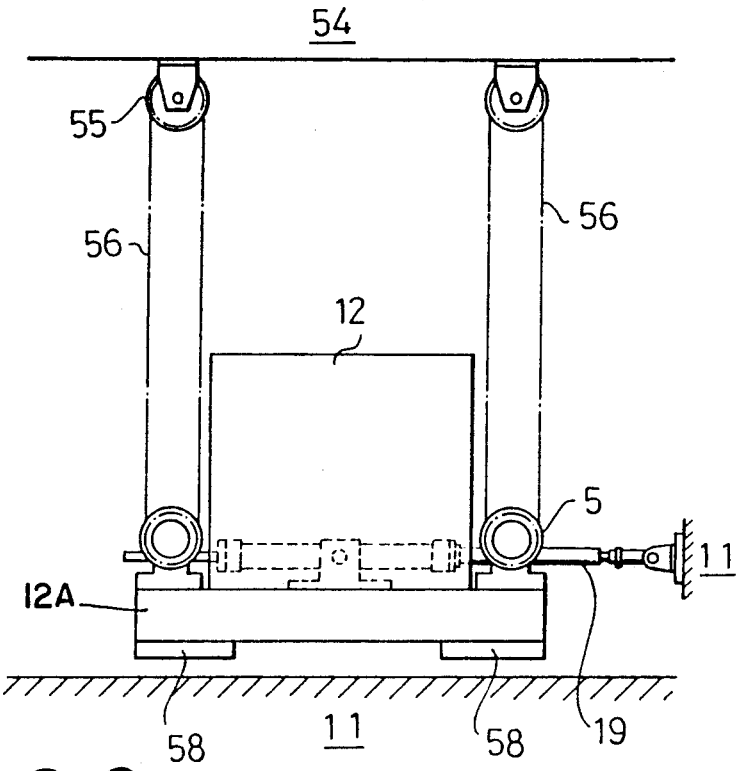
FIGS. 8, 9 and 10 are a front view, a right side view and a plan view showing the appearance of the apparatus according to the present invention, respectively.
Figure 9:
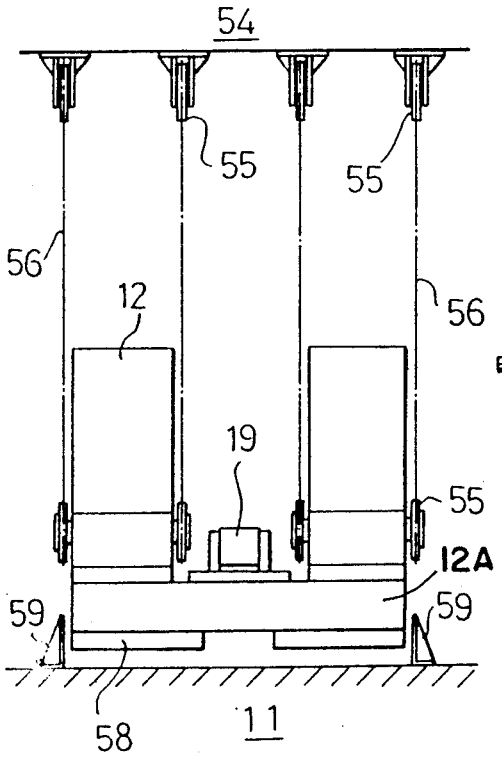
Figure 10:
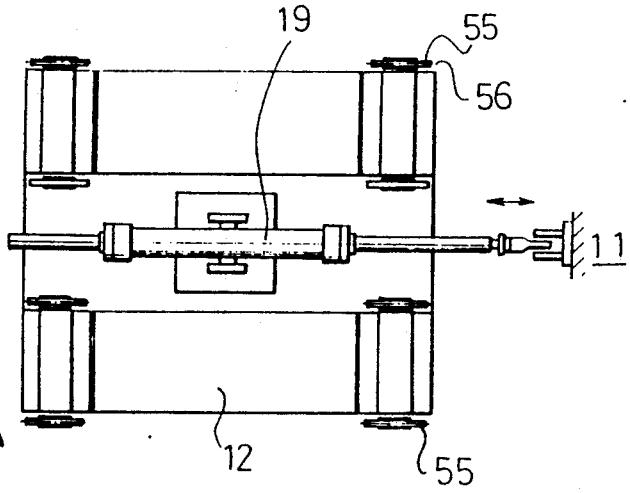

FIGS. 8 to 10 show the construction of the active mass driver in a preferred embodiment of the positive vibration suppression apparatus according to the present invention. The weight 12 has a substantially channel-shaped side view, and it is suspended from an upper steel frame 54. It is suspended at eight points via upper and lower pulleys 55 and hanging media 56 such that it extends horizontally and is capable of movement relative to the building body 11. In the horizontal direction, the weight 12 is connected to the building body 11 by the oil hydraulic cylinder acting 19 as an actuator. The oil hydraulic cylinder 19 is operated for expansion and contraction according to an instruction from a control mechanism to apply a control force to the building body 11.

The weight 12 has the channel-shaped outer shape in order to install the oil hydraulic cylinder 19 in the depression, thus reducing the installation space and obtaining a compact construction. Further, it is possible to let the pulley hanging point, centroid of the weight 12 and pressure application point of the oil hydraulic cylinder 19 to coincide with one another, which is convenient for the design.

Buffering members 58 are attached to the lower surface of the weight 12 at four points, so that the apparatus can be protected against an accident such as occasional breakage of the hanging media 56. The lower end of the weight 12 is guided by four guide members 59 to prevent twisting of the movement of the weight 12.

Figure 5:
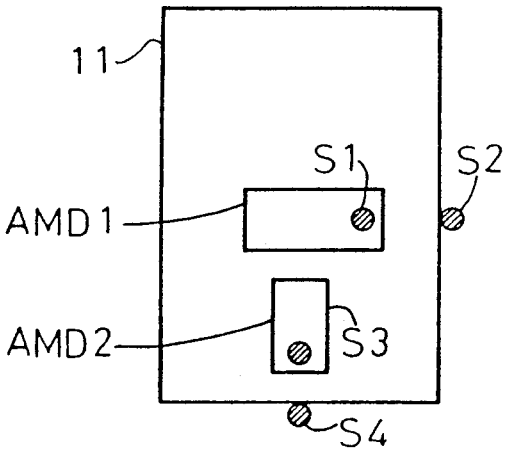
FIG. 5 is a plan view showing an embodiment of the invention, in which two vibration suppression apparatuses are disposed in perpendicular directions.

FIG. 5 shows an embodiment consisting of two perpendicular vibration suppression apparatuses disposed on the top of the building to provide control in two, i.e., X- and Y-, directions of the building. In FIG. 5, the vibration suppression apparatus in the X-direction is a main vibration suppression apparatus AMD1, and the apparatus in the Y-direction is an auxiliary vibration suppression apparatus AMD2. Vibrations in all directions can be controlled through control of the two perpendicular vibration suppression apparatuses AMD1 and AMD2. Designated at S1 to S4 are acceleration gauges as vibration sensor means.

Figure 6:
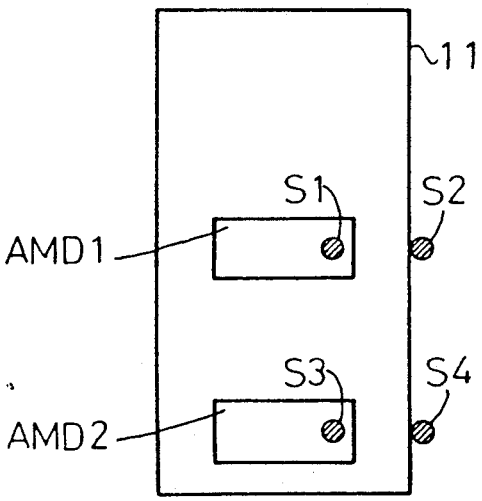
FIG. 6 is a plan view showing another embodiment, in which a vibration suppression apparatus for suppressing torsional vibrations is provided.

FIG. 6 shows another embodiment consisting of two vibration suppression apparatuses provided at the center and an end of the top of the building and extending in the same direction. The central apparatus AMD1 is a main apparatus for effecting main control, and the apparatus AMD2 at the end is an auxiliary apparatus for controlling the torsional vibration component. This embodiment is suited for control of an eccentric building.

Figure 7:
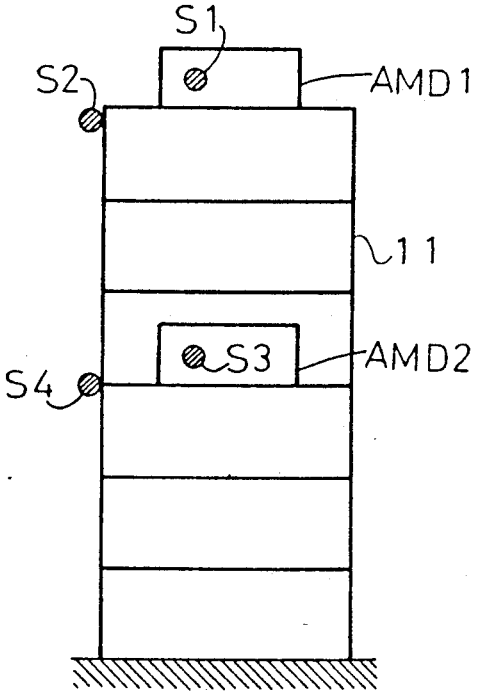
FIG. 7 is a view showing a further embodiment, in which vibration suppression apparatuses are arranged to permit simultaneous control of primary and secondary vibration components.

FIG. 7 is a further embodiment of the apparatus for a high story building. The primary vibration component is controlled by the vibration suppression apparatus AMD1 provided at the top of the building. The secondary vibration component is controlled by the vibration suppression apparatus AMD2 provided on a story corresponding to the node of the secondary vibration mode.

What is claimed is:

1. Apparatus for suppressing vibrations of a building, comprising: a source of electric energy; a first high capacity electric motor connected to said source of electric energy; a first high capacity hydraulic pump drivingly connected to said first electric motor; a pressure regulator valve connected to said first hydraulic pump; a second low capacity electric motor connected to said source of electric energy with said first electric motor; a second low capacity hydraulic pump drivingly connected to said second electric motor; an hydraulic cylinder and piston; an hydraulic servo valve connected to said hydraulic cylinder, said first and second hydraulic pumps being connected in parallel to said hydraulic serve valve; an hydraulic fluid accumulator connected to said hydraulic servo valve; means for pressurizing and recirculating hydraulic fluid in said hydraulic fluid accumulator by said second hydraulic pump; a source of hydraulic fluid connected to said first hydraulic pump; a shiftable mass; said hydraulic cylinder being connected to said shiftable mass; said piston being connected to said building; means to sense vibration of said building and to generate a signal responsive thereto; means to sense vibration of said shiftable mass and to generate a signal responsive thereto; means to compare said signals and to generate signals responsive thereto to actuate said hydraulic servo valve, to actuate said accumulator, to actuate said hydraulic cylinder and piston to shift said mass, to actuate said first electric motor and said first hydraulic pump, and to actuate said pressure regulator valve to connect said first hydraulic pump to said hydraulic servo valve.

2. The apparatus of claim 1, wherein said mass is suspended from overhead anti-friction support means adapted to permit said mass to be shifted n a substantially horizontal plane.

3. The apparatus of claim 2, wherein said mass is configured to permit said hydraulic pump to be mounted at the center of gravity of said mass.

4. The apparatus of claim 3, wherein said pump is mounted on said mass at the center of gravity of said pump.

5. The apparatus of claim 4, wherein said piston is adapted to apply a thrust to said mass, the center of effort of which coincides with the center of gravity of said mass.

6. The apparatus of claim 3, wherein said mass is of U-shaped configuration.

7. The apparatus of claim 2, wherein said mass has a rectangular base and is suspended from the four corners of said base by wire rope means.

8. The apparatus of claim 7, wherein said anti-friction support means comprise four lower pulley means secured to the four corners of said rectangular base, four upper matching pulley means secured to said overhead support means, and said wire rope means interconnected between said upper and lower pulley means.

9. The apparatus of claim 7 and guide means to prevent said mass from twisting on said wire rope means.

10. The apparatus of claim 7, including shock absorber means secured to the underside of said base.

11. The apparatus of claim 6, wherein said hydraulic cylinder and piston are pivotally mounted within said U-shaped mass at the center of gravity of said hydraulic cylinder and piston, and the free end of said piston is pivotally secured to said building.

12. The apparatus of claim 1, wherein a first said apparatus is mounted in said building in a predetermined alignment relative to said building, and a second said apparatus is mounted in said building on the same plane as said first apparatus but transversely aligned to said first apparatus.

13. The apparatus of claim 12, wherein said first apparatus is mounted on the vertical center line of said building and said second apparatus is mounted proximate to a side wall of said building.

14. The apparatus of claim 7, wherein a first said apparatus is mounted in said building in a predetermined alignment relative to said building, and on the vertical center line of said building; and wherein a second said apparatus is mounted in said building on the same plane as said first apparatus and parallel thereto proximate to a side wall of said building.

15. The apparatus of claim 1, wherein a first said apparatus is mounted on an upper level of said building, and a second said apparatus is mounted on a level of said building substantially midway between said upper level and the ground level of said building.

16. The apparatus of claim 1, wherein a first said apparatus is mounted on substantially the highest level of said building, and a second said apparatus is mounted on a level of said building proximate to the node of the natural frequency of the said building.

17. The apparatus of claim 1, including a control signal generating circuit adapted to receive and to process said sensor generated signals and to generate a resultant signal; a comparator circuit adapted to receive said resultant signal; said signal generated by said shiftable mass sensor being transmitted to and processed by said comparator circuit, and said comparator circuit being adapted to generate and to transmit a signal to actuate and to control the operation of said servo valve.

18. The apparatus of claim 17, including parallel amplifying circuits adapted to amplify and to control amplification of said sensor generated signals.

19. The apparatus of claim 18, wherein said amplifying circuits are provided with phase control means to compensate for mechanical time delay of the movement of said shiftable mass relative to the sensed vibrations of said building.

20. The apparatus of claim 19, wherein said circuit for amplifying said building sensor generated signal includes an automatic gain control circuit adapted to control the level of said building sensor generated signal when said signal is compared with the said shiftable mass sensor generated signal.

21. The apparatus of claim 20, including an automatic gain control circuit adapted to control the output level of the resultant signal from said amplifying circuits.

22. The apparatus of claim 19, wherein said phase control means include an integrating circuit and a phase controller.

23. The apparatus of claim 1, wherein said accumulator is in parallel with said first and second hydraulic pumps.

24. The apparatus of claim 1, including a signal control circuit adapted to receive said sensor generated signals, to compare said signals, and to generate a signal to control said hydraulic cylinder and piston.

25. The apparatus of claim 24, including a power supply control circuit adapted to be actuated by said signal control circuit.

* * * * *

UNITED STATES PATENT AND TRADEMARK OFFICE

CERTIFICATE OF CORRECTION

PATENT NO. : 5,022,201

DATED : June 11, 1991

INVENTOR(S) : Takuji Kobori, et al.

It is certified that error appears in the above-identified patent and that said Letters Patent is hereby corrected as shown below:

The title page and columns 1-12 should be deleted and substitute the attached title page and columns 1-12 therefor.

Signed and Sealed this

Seventh Day of April, 1992

*Attest:*

HARRY F. MANBECK, JR.

*Attesting Officer*

*Commissioner of Patents and Trademarks*

United States Patent [19]

Kobori et al.

[11] Patent Number: 5,022,201

[45] Date of Patent: Jun. 11, 1991

[54] APPARATUS FOR ACCELERATING RESPONSE TIME OF ACTIVE MASS DAMPER EARTHQUAKE ATTENUATOR

[75] Inventors: Takuji Kobori; Mitsuo Sakamoto; Toshikazu Yamada; Isao Nishimura, all of Tokyo; Koji Ishii; Jun Tagami, both of Chofu, all of Japan

[73] Assignee: Kajima Corporation, Tokyo, Japan

[21] Appl. No.: 343,085

[22] Filed: Apr. 25, 1989

[30] Foreign Application Priority Data

| | | | |
|---|---|---|---|
| Apr. 26, 1988 | [JP] | Japan | 63-102940 |
| Apr. 26, 1988 | [JP] | Japan | 63-102941 |
| Apr. 26, 1988 | [JP] | Japan | 63-102942 |
| Apr. 26, 1988 | [JP] | Japan | 63-102943 |

[51] Int. Cl.[5] ..... E04H 9/02

[52] U.S. Cl. ..... 52/167 DF

[58] Field of Search ..... 52/167, 167 DF

[56] References Cited

U.S. PATENT DOCUMENTS

| | | | |
|---|---|---|---|
| 3,940,895 | 3/1976 | Yamamoto et al. | 52/167 |
| 4,793,105 | 12/1988 | Caspe | 52/167 DF |
| 4,799,339 | 1/1989 | Kobori et al. | 52/167 DF |
| 4,841,685 | 6/1989 | Masri et al. | 52/167 DF |

FOREIGN PATENT DOCUMENTS

| | | | |
|---|---|---|---|
| 59-97341 | 6/1984 | Japan | 52/167 DF |

OTHER PUBLICATIONS

J. N. Yang, "Optimal Control Theory to Civil Engineering Structures," *Journal of the engineering Mechanics Division,* vol. 101, No. EM6, Dec. 1975, pp. 819–838.

James C. H. Chang and Tsu T. Soong, "Structural Control Using Active Tuned Mass Dampers," *Journal of the Engineering Mechanics Division,* vol. 106, No. EM6, Dec., 1980, pp. 1091–1098.

J. N. Yang, "Control of Tall Buildings under Earthquake Excitation," *Journal of the Engineering Mechanics Division,* vol. 108, No. EM5, Oct., 1982, pp. 833–849.

*Primary Examiner*—Richard E. Chilcot, Jr.
*Assistant Examiner*—Michele A. Van Patten
*Attorney, Agent, or Firm*—James H. Tilberry

[57] ABSTRACT

Apparatus which actively suppresses vibrations of a building caused by earthquakes or winds by applying a control force to the building. The apparatus comprises a mass suspended on the top of the building and an actuator connecting the mass to the building. The apparatus is actuated by sensing the vibrations of the building, whereinafter the mass is vibrated in a manner calculated to minimize the building vibrations. The apparatus is protected from damage when its damping capacity is exceeded by synchronizing the apparatus and building so as to minimize relative movement therebetween. Small and large size oil hydraulic pumps, connected to respective small and large size electric motors, and an accumulator are provided in parallel. By continuous operation of the small pump only, the apparatus is warmed up at all times and ready for accumulator/large pump oil hydraulic control with intervening small motor low power consumption. Two or more vibration suppression apparatuses are simultaneously controlled, depending on the shape of the building, to damp both torsional and other secondary vibration components.

25 Claims, 5 Drawing Sheets

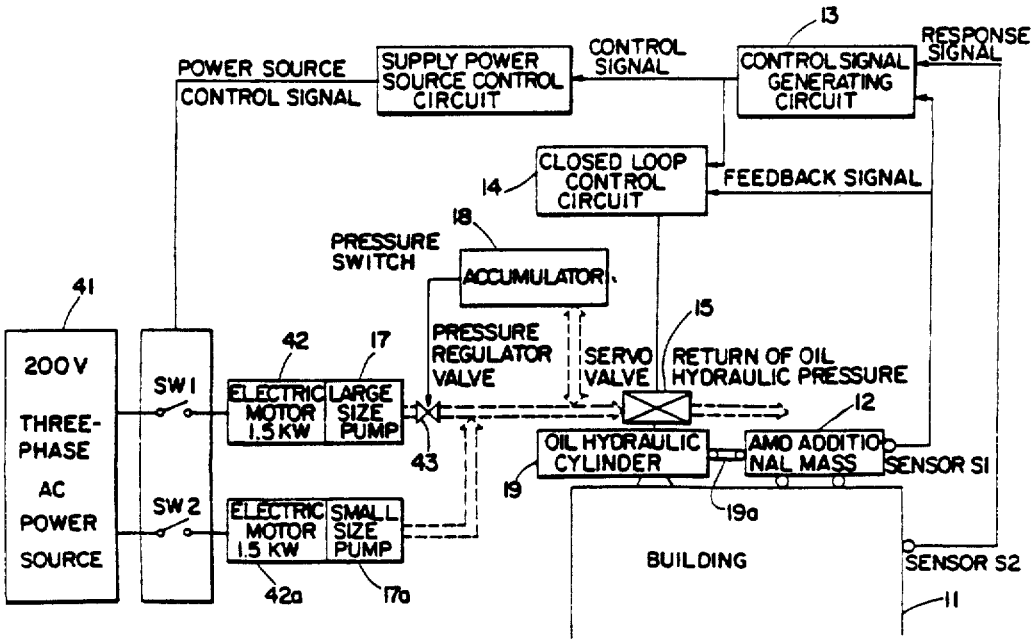

APPARATUS FOR ACCELERATING RESPONSE TIME OF ACTIVE MASS DAMPER EARTHQUAKE ATTENUATOR

BACKGROUND OF THE INVENTION

1. Field of the Invention

This invention relates to an apparatus for positively suppressing vibrations of building structures caused by such external forces as earthquakes and winds.

2. Description of the Prior Art

The inventors previously invented an apparatus for positively suppressing vibrations of a building comprising an additional mass damper (AMD) and an actuator positioned on the top of the building. When the building is subjected to external forces, such as vibrations caused by earthquakes or winds, the additional mass is counter-vibrated by an actuator to suppress the vibrations imposed on the building. Such an apparatus is disclosed in Japanese Patent Laid-open Publications Nos. 62-268478 and 63-78974 and in prior art FIG. 1 of this application.

Figure 1:
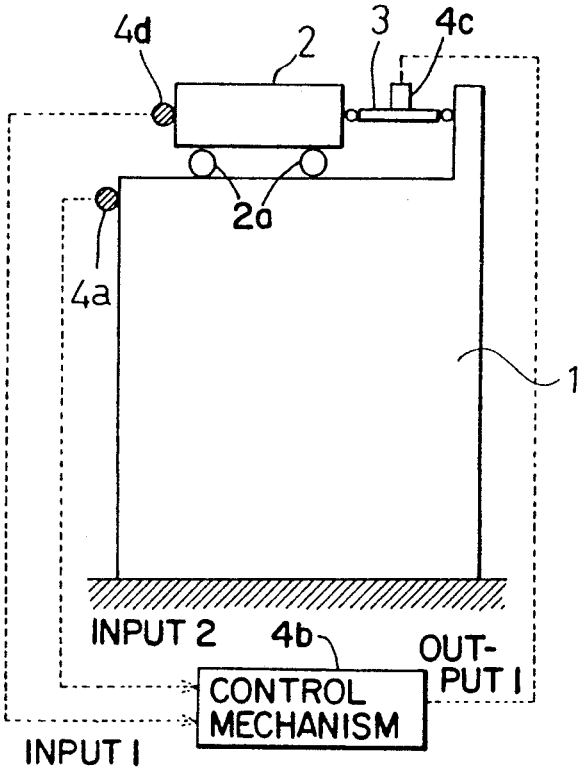
(PRIOR ART) FIG. 1
FIG. 1 is a view illustrating the principles of a positive vibration suppression apparatus.

In FIG. 1 there is schematically shown a vibration suppression apparatus located on the top of a building 1. A mass 2 is mounted on anti-friction rollers 2*a* and is connected to the building by an actuator 3. When vibrations are imposed on the building 1 by an earthquake or winds, a sensor 4*a*, mounted in the building 1, senses the vibrations and transmits a signal to a control circuit 4*b*. Control circuit 4*b*, in turn, transmits an output signal, corresponding to the vibrations, to a servo valve 4*c* connected to control the actuator 3. A second sensor 4*d* may be secured to the actuator 3 to provide feedback control of the movement of the actuator 3.

While the above control is based on a closed loop circuit control, it is also possible to measure the building response through analysis of earthquake waves supplied from wide and narrow bandwidth seismometers and to combine the results of the analysis with an open loop circuit control. However, delays with respect to the signal in the operation time have been experienced in mechanical parts of the apparatus. These delays should be reduced in order to improve the effectiveness of the system.

Furthermore, earthquakes and winds are natural phenomena whose intensities cannot be forecast. Therefore, if the maximum performance of prior art apparatus is designed to cope with the more frequently occurring medium scale earthquakes and wind velocities of 15 m/sec. or less, it is necessary to protect the apparatus from overload when exposed to large scale earthquakes or ultra-high wind velocities. Thus, failsafe means are necessary to protect prior art apparatus from destructive overload.

Since no one can forecast an earthquake, the apparatus should be rendered operative as soon as an earthquake strikes. With prior art apparatus, a time lag occurs until an oil hydraulic system can be actuated. Thus, it is necessary to have prior art apparatus maintained at the ready at all times if it is to be of any value during an earthquake. For this reason, prior art systems have high operating costs and low life expectancies. Further, since strong winds vary in intensity, it is not cost efficient to use the largest capacity electric motor for winds of less than maximum intensity.

In prior art devices such as illustrated in FIG. 1, the weight 2, which is made of steel, has a mass of about 1/100 of the mass of the building. The force of the actuator 3 should be smoothly transmittable to the weight, and the installation space should be as small as possible.

The actuator 3 desirably operates at a comparatively high speed, has a large capacity, and is preferably an oil hydraulic cylinder with a long stroke, restricted only by the available installation space.

The weight 2 has a large mass, and it is therefore necessary to reduce the influence of frictional forces as much as possible to obtain efficient and reliable vibration suppression. The prior art oil hydraulic cylinder actuator 3 is limited in its ability to suppress vibrations from random directions. Thus, depending on the design of the building, it is usually only possible to obtain a comparatively large vibration damping effect in one direction. However, externally applied forces due to earthquakes and winds are uncertain forces, and, in irregularly shaped buildings, other means may be necessary to suppress vector components of vibrations. Further, in very tall buildings, secondary vibration components are often large, and these too need to be suppressed.

SUMMARY OF THE INVENTION

A positive vibration suppression apparatus according to the present invention basically provides a control force in opposition to an external vibrating force and proportional to the speed of vibrations. More specifically, a signal from vibration sensor means provided on or in a building is amplified and adapted to control an actuator. The actuator acting on a large mass is the control force which suppresses the building vibration.

According to one aspect of the invention, the building and control force mass are provided with separate vibration sensor means for sensing their respective vibrations, and amplifying circuits are provided in parallel to amplify response signals from the respective vibration sensor means. Mechanical delay can be compensated for by providing phase control means in the amplifying circuits. The phase control means includes an integrating circuit to cause a phase shift of 90 degrees so that it can control a phase within a range of 0 to 90 degrees. It is thus possible to control the phase (within a range of $\pm 180$ degrees) responsive to the delays in the control force mechanical parts. The amplifying circuit for amplifying the response signal from the building side vibration sensor means is provided with an automatic gain control circuit for controlling the signal level. An automatic gain control circuit is also provided for controlling the output level of a resultant signal obtained from the two amplifying circuits on the building side and on the control force side.

If acceleration gauges are used as vibration sensor means, it is possible to sense very small vibrations and higher order vibrations, in which event the phase delay can be easily compensated for to permit phase control of the actuator in cooperation with the phase control means noted above.

As noted above, according to the invention, it is possible to compensate for the mechanical time delay by the provision of phase control means in the amplifying circuits. Further, it is possible to control the level of a signal when combining the building side response signal with the amplified control force side response signal by providing the automatic gain control circuit in the amplifying circuit for amplifying the building side response signal. Thus, when vibrations of the building are faint, it is still possible to maintain control, since the amplification factor for the building side response signal is large. When the vibration intensity of the building increases, the amplification factor of the building side response signal is proportionately reduced, and the magnitude of the control force is increased. However, the capacity of the vibration suppression apparatus is limited and the apparatus can only function effectively within a fixed capacity range irrespective of the intensity of the vibrations of the building. Therefore, when the building vibrations exceed the capacity of the control force, the control force mass is moved substantially in unison with the building (i.e., it is substantially stationary with respect to the building), thereby insuring the safety of the control force apparatus. When the vibrations of the building are reduced with attenuation of an earthquake, the amplification factor for the building side response signal is increased by the action of the automatic gain control circuit, so that it is possible to regain control for effectively suppressing the vibrations of the building. Further, with respect to the output of the resultant signal the output level thereof is further amplified by the automatic gain control circuit. Therefore, the vibration suppression apparatus will not respond to vibrations of the building which exceed the capacity of the control apparatus.

It is possible to greatly extend the capacity of the control apparatus by combining the vibration suppression apparatus with vibration-proof structure, vibration absorbers and other vibration suppression apparatus.

A preferred embodiment of the inventive positive vibration suppression apparatus includes an oil hydraulic pressure source; a small size oil hydraulic pump connected to a small size electric motor; a large size oil hydraulic pump connected to a large size electric motor; and a large capacity accumulator. Both pumps and motors are connected in parallel with the accumulator. However, only the small size pump and electric motor are held operative to build and to maintain oil hydraulic pressure in the accumulator at all times. In an initial stage of an earthquake, necessary oil hydraulic pressure is supplied from the accumulator. During this time, the large size electric motor is started to operate the large size oil hydraulic pump for supplying the necessary oil hydraulic pressure during the final stages of the earthquake.

When an earthquake occurs, the large size electric motor is started by an electric signal transmitted from the control circuit of the positive vibration suppression apparatus. The large size electric motor operates the large size oil hydraulic pump to effect warming-up of the apparatus while the accumulator is still supplying oil hydraulic pressure necessary for the initial stage of the earthquake. Before the accumulator loses effective pressure, the large size oil hydraulic pump takes over the supply of the oil hydraulic pressure.

In a different aspect of the invention, an oil hydraulic cylinder, with which a large stroke can be comparatively easily obtained, is used as the actuator. The center of the oil hydraulic cylinder is supported by a pin on the gravitational axis of the control force mass via a center trunion or the like (see FIG. 8). The piston of the oil hydraulic cylinder has its free end in a pin and clevis connection, or the like, with a section of the building. Since the oil hydraulic cylinder is mounted on and within the confines of the control force mass, there is no need to provide additional installation space for the oil hydraulic cylinder. Further, since the center of the oil hydraulic cylinder is supported by a pin at a position on the gravitational axis of the weight, smooth transmission of force can be obtained compared to the case where the center of the oil hydraulic cylinder is connected to an end of the control force mass. Also, since the free end of the oil hydraulic cylinder is pivotally connected to the building, it is possible to compensate for the pendulum-like vertical movement of the control force mass produced with its horizontal movement. This arrangement permits even transmission of force.

By forming the control force mass in a channel-shaped profile (see FIG. 9), it is possible to position the axis of the oil hydraulic cylinder to pass through the centroid of the weight, thus permitting smooth transmission of the force. The control force mass is about 1/100 of the mass of the building, and it is suitably made of such metal as steel or lead from the consideration of the available space factor.

In order to minimize the mechanical time delay during start-up of the vibration suppression apparatus responsive to earthquake vibrations, it is necessary to reduce the friction in the mechanical parts of the apparatus as much as possible. To this end, it is desired to suspend the control force mass via hanging means, such as wires. For this purpose, a steel frame is built on the top of or in the building, and the control force mass is suspended from the frame via the wire hanging means. The control force mass is preferably suspended at a plurality of points, for instance, four or eight points, to prevent the rotation of the mass. Further it is desirable to thread the wires through pulleys to minimize frictional losses between the wire, the supporting frame and the mass. This anti-friction suspension system facilitates control of even very small vibrations. Shock absorbers may be secured to the underside of the mass as a safeguard against an accidental breaking of one or more of the support wires. It is also desirable to provide guide plates adjacent the sides to damp torsional vibrations of the mass.

In a further aspect of the invention, a plurality of vibration suppression apparatuses as described above may be discretely arrayed about a building to suppress compound vibrations by simultaneously controlling the plurality of vibration suppression apparatuses. These vibration suppression apparatuses may utilize a common oil hydraulic pressure source to simplify the equipment.

More specifically, it is possible to obtain control of building vibrations acting in perpendicular directions with two vibration suppression apparatuses (see FIG. 5). Further, when it is intended to control vibrations in a particular direction, a main vibration suppression apparatus is installed at the center of the building, and an auxiliary vibration suppression apparatus is installed at an end wall of the building aligned in the same direction as the main vibration suppression apparatus for controlling the torsional component of vibrations of the building (see FIG. 6). Further, for a very tall building, an auxiliary vibration suppression apparatus may be provided on a floor constituting the node of secondary vibration, in addition to a simultaneously controlled main suppression apparatus provided on the top of the building. The auxiliary vibration suppression apparatus controls the secondary vibration component of the building (see FIG. 7).

OBJECTS OF THE INVENTION

An object of the present invention is to provide an apparatus for positively suppressing vibrations of building structures, in which a control signal generating circuit for controlling the operation of an actuator, such as an oil hydraulic cylinder, is provided with phase control means to permit compensation of mechanical time delay with respect to the operation of the actuator.

Another object of the invention is to provide, in the case where the maximum performance of the vibration suppression apparatus is limited to deal with frequently occurring medium scale earthquakes, an amplifying circuit for amplifying a building side response signal with an automatic gain control circuit, for preventing excessive operation of the apparatus at the time of occurrence of large scale earthquakes to maintain the safety of the apparatus.

A further object of the invention is to provide an economical vibration suppression apparatus, in which an oil hydraulic apparatus for generating great control force is combined with an electric control circuit to effectively suppress vibrations of a building.

It is among other objects of the invention to provide a small size electric motor and a small size pump which are continuously operated and which are combined with a large size electric motor and a large size pump so that the apparatus can be held warmed up at all times and can immediately start vibration control, without application of excessive load on the system at the time of the start up of the large size electric motor, to provide a vibration control system that consumes low power, requires low running cost, and has a long and economical life.

A further object of the invention is to provide a vibration suppression apparatus which has a compact construction and which permits smooth transmission of force by an oil hydraulic cylinder actuator at the centroid of the control force mass.

A still further object of the invention is to provide a vibration suppression apparatus in which the control force mass is suspended to reduce friction loss, eliminate rotation of the suspended mass, and permit effective vibration control.

A yet further object of the invention is to provide a vibration suppression apparatus which is mechanically simple and which can be installed in an existing building.

A yet further object of the invention is to provide a method for suppressing vibrations in which a plurality of vibration suppression apparatuses are commonly controlled to damp vibrations acting in perpendicular directions; to damp torsional vibration components; and to damp secondary vibration components.

BRIEF DESCRIPTION OF THE DRAWINGS

The foregoing and other objects and features of the invention will become apparent from the following description of preferred embodiments of the invention with reference to the accompanying drawings, in which:

FIG. 1 is a schematic elevational view of a building illustrating prior art principles of a positive vibration suppression apparatus;

FIG. 2 is a block diagram of a preferred embodiment of an inventive oil hydraulic system positive vibration suppression apparatus;

FIG. 3 is a block diagram showing a signal generating circuit of the positive vibration suppression apparatus according to the present invention;

FIG. 4 is a block diagram showing another oil hydraulic system of the positive vibration suppression apparatus according to the present invention;

FIG. 5 is a schematic plan view showing an embodiment of the invention in which two vibration suppression apparatuses are disposed in perpendicular relationship with respect to each other;

FIG. 6 is a schematic plan view showing another embodiment of the invention in which a vibration suppression apparatus for suppressing torsional vibrations is provided;

FIG. 7 is a schematic elevational view showing a further embodiment of the invention in which vibration suppression apparatuses are arranged to permit simultaneous control of primary and secondary vibration components; and FIGS. 8, 9 and 10 are a front elevational view, a side elevational view, and a plan view showing a positive vibration suppression apparatus according to the present invention.

DETAILED DESCRIPTION OF THE PREFERRED EMBODIMENTS

FIG. 2 is a schematic block diagram showing an oil hydraulic system of a positive vibration suppression apparatus according to the present invention. Acceleration gauges S1 and S2 are provided as vibration sensors on an active mass driver (AMD) 12 and on a building 11, respectively. Sensors S1 and S2 provide response signals to a control signal generating circuit 13. The control signal generating circuit 13 provides phase control and amplification of the signal inputs to produce a control signal which is transmitted to a comparator circuit 14. Simultaneously, the sensor S1 also provides an output signal to the comparator circuit 14 for feedback control. The comparator circuit 14 transmits a control signal to an oil hydraulic servo valve 15 provided on an oil hydraulic cylinder 19 to control the oil hydraulic servo valve 15. The oil hydraulic system comprises a loop including an oil hydraulic tank 15, an oil hydraulic pump 17, an oil hydraulic servo valve 15, an oil hydraulic cylinder 19, and an accumulator 18 positioned between the oil hydraulic pump 17 and the oil hydraulic servo valve 15.

The oil hydraulic cylinder 19 can be operated under control by the oil hydraulic servo valve 15 to provide a reaction force to the mass 12 of the vibration suppression apparatus to suppress vibrations of the building 11.

FIG. 3 is a block diagram showing the control signal generating circuit. In this embodiment, as shown in FIG. 6, in addition to a main vibration suppression apparatus shown at AMD1, an auxiliary vibration suppression apparatus AMD2 is installed at one side of the building to control the torsional component of vibrations. In FIG. 3, an input 1A represents the acceleration of a mass of the main vibration suppression apparatus installed at the top center of the building as sensed by the sensor S1 shown in FIG. 6. Inputs 2A and 4A represent the acceleration of the top center of the building as sensed by the sensor S2, and input 3A represents the acceleration of a mass of the auxiliary vibration suppression apparatus AMD2 installed at one side of the top of the building as sensed by the sensor S3, and an input 5A represents the acceleration of one side of the top of the building as sensed by the sensor S4.

The input 1A is passed through a low-pass filter 21 to remove very small vibration components and noise components, amplified by a buffer amplifier 22 and then supplied through an integrating circuit 23 and also directly to a phase controller 24. Since the input 1A represents the acceleration, it is 90 degrees out of phase with respect to the velocity and also contains a mechanical time delay introduced in the mechanical part such as the oil hydraulic cylinder 19 (see FIGS. 2 and 8 to 10). Therefore, if necessary, it is subjected to 90-degree phase adjustment in the integrating circuit 23 and then to a phase control in a range of 0 to 90 degrees in the phase controller 24. Subsequently, its signal level is adjusted in an amplifier 25.

The input 2A likewise is subjected to removal of very small vibration components and noise components, subjected to phase control, and then passed through an automatic gain control circuit 26, thereby controlling its signal level to a preset level. The control signal is 90 degrees out of phase with respect to the phase of vibrations of the building. The inputs 1A and 2A are combined through parallel amplifiers, as noted above.

The driving of the mass 12 (FIG. 2) of the vibration suppression apparatus should be done within its capacity, since its amplitude is limited, whereas there is a large acceleration range of the vibrations of the building 11, depending on the scale of earthquake. Therefore, an automatic gain control circuit (AGC) 26 is provided on the side of the building, so that the amplification factor of the building side circuit is high when the building side acceleration is low, while it is low when the building side acceleration is high. Thus, while control 90 degrees out of phase with respect to vibrations of the building 11 is done according to the vibrations with a low building side acceleration, with increase of the building side acceleration the oil hydraulic cylinder 19 is no longer operative so that the mass 12 is stationary with respect to the building 11. With reduction of the building side acceleration, the amplification factor of the building side circuit is increased again to reduce the period of attenuation of vibrations of the building 11.

The resultant signal obtained from the parallel amplifiers is also passed through a gain control circuit (AGC) 28 to obtain a preset signal level for controlling the movement of the mass 12 within the capacity of the apparatus.

The input 3A, which represents the acceleration of the mass of the auxiliary vibration suppression apparatus AMD2, is controlled in an amplifier like the input 1A noted above. The inputs 4A and 5A, which represent the accelerations of the center and one end of the building, respectively, are passed through respective low-pass filters **21*c* and 21*d* and buffer amplifiers 22*c* and 22*d* before being supplied to a differential amplifier 30 to obtain their difference. The torsional vibration component is subjected to the same control as with the input 2A before being combined with the input 3A passed through the amplifier, and the resultant signal is passed through an automatic gain control circuit 28*b*** to obtain a control signal with respect to the mass of the auxiliary vibration suppression apparatus AMD2.

FIG. 4 is a block diagram showing a single-system positive vibration suppression apparatus including an oil hydraulic system according to the present invention. It uses a 4-ton weight 12 to suppress vibrations of a 400-ton building 11.

In this embodiment, a 200-V three-phase AC power source 41 is used to hold a 1.5-kW small size electric motor **42*a* continuously operative. A servo valve 15 operates to continuously supply hydraulic fluid at a rate of 2 to 3 liters per minute so that the apparatus is warmed up at all times. Oil under pressure is also stored in the accumulator 18 (80 liters) by the 1.5-kW small size electric motor 42*a* and a small size pump 17*a* connected thereto, so that pressurized operating fluid, necessary in an initial stage of an earthquake, is readily available from this accumulator. Thus, a satisfactory initial control state is maintained. Before the oil pressure in the accumulator 18 is reduced below adequate requirements, the large size electric motor 42 and the large size pump 17 will have become fully operative and able to deliver the necessary hydraulic pressure to the cylinder 19**.

The accumulator 18 is provided with a pressure switch as pressure sensor means. When the pressure rises at the time of the start of control, a pressure control valve 43 is controlled to cause circulation of oil between the large size pump 17 and the tank 16 (see FIG. 2) so as to keep the load on the 15-kW large size electric motor at a minimum. When the oil hydraulic pressure is reduced to a predetermined pressure, the pressure regulator valve 43 is opened to the side of the oil hydraulic control circuit to control the pressure of operating fluid flowing from the large size pump 17 connected to the 15-kW large size electric motor 42. Thus, the load on the 15-kW large size electric motor is controlled to save power consumption. The 15-kW large size electric motor 42 is held warmed up in an idling state with a small load while the operating fluid is circulated between the large size pump 17 and the tank 16.

The vibration suppression apparatus described above provides vibration suppression (FIGS. 2 and 4) as follows. The sensor S2 senses vibrations of the building 11 and transmits a response signal to the control signal generating circuit 13. The control signal generating circuit 13 transmits a control signal to the servo valve 15 and power source 41 to start control of the hydraulic pressure and servo valve 15. At the same time, the switch SW1 of the large size electric motor 42 is closed.

Meanwhile, the sensor S1 senses the movement of the mass 12 with the operation of the oil hydraulic cylinder 19 and supplies a response signal to the control signal generating circuit 13. Pursuant to the principle of active vibration suppression, the vibrations of the building body 11 are controlled by applying a force tending to cause offsetting vibrations. The control circuit 13 controls the phase of mechanical time delay due to friction and other causes and supplies a control signal to the servo valve 15. Error correction is obtained by feedback from the movement of the mass 12.

When the vibration control is started, the pressure regulator valve 43 senses a pressure reduction in about 5 seconds, and the oil hydraulic control is continued through control of the load of the large size electric motor 42.

FIGS. 8 to 10 show the construction of the active mass driver in a preferred embodiment of the positive vibration suppression apparatus according to the present invention. The mass 12 has a substantially channel-shaped side profile, and is suspended from an upper steel frame 54. It is suspended at eight points via upper and lower pulleys 55 and suspension means 56, such as steel wire rope. The base 12A of the mass 12 is substantially horizontal, and is capable of movement responsive to the movement of the building 11. The mass 12 is connected to the building 11 by horizontally mounted oil hydraulic cylinder 19 acting as an actuator. The piston of the oil hydraulic cylinder 19 is operated to extend and to contract according to instructions from the control means of FIGS. 2 and 4, above described, to apply a control force to the building 11.

The mass 12 has a channel-shaped configuration to provide installation space for the oil hydraulic cylinder 19 between the upstanding portions of the channel. With this construction, it is possible for the center of gravity of the mass 12 and the center of effort of the oil hydraulic cylinder 19 to coincide with one another, which is good design to reduce random movement of the mass 12.

Shock absorber pads 58 are attached to the lower surface of the mass 12 at the four corners of its base, so that the apparatus can be protected against an accident such as breakage of the suspension means 56. To further reduce random movement of the mass 12, the base 12A is guided by four guide members 59 to prevent twisting of the mass 12 during movement.

FIG. 5 shows an embodiment consisting of two vibration suppression apparatuses normally positioned on the top of the building to provide two-directional control, i.e., along Cartesian coordinate X and Y horizontal directions of the building. In FIG. 5, the vibration suppression apparatus in the X direction is a main vibration suppression apparatus AMD1, and the apparatus in the Y direction is an auxiliary vibration suppression apparatus AMD2. Vibrations in all directions can be controlled through control of the two perpendicular vibration suppression apparatuses AMD1 and AMD2. Designated at S1 to S4 are acceleration gauges as vibration sensor means.

FIG. 6 shows another embodiment of the invention consisting of two vibration suppression apparatuses provided at the center and at a side of the top of the building and similarly aligned. The center apparatus AMD1 is a main apparatus for effecting main control, and the apparatus AMD2 at the side of the building is an auxiliary apparatus for controlling the torsional vibration component. This embodiment is suited for control of an irregularly shaped building.

FIG. 7 is another embodiment of the apparatus for a multi-storied building. The primary vibration component is controlled by the vibration suppression apparatus AMD1 provided at the top of the building. The secondary vibration component is controlled by the vibration suppression apparatus AMD2 provided on a building level corresponding to the node of a secondary vibration.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

We claim:

1. Apparatus for suppressing vibrations of a building, comprising: a source of electric energy; a first high capacity electric motor connected to said source of electric energy; a first high capacity hydraulic pump drivingly connected to said first electric motor; a pressure regulator valve connected to said first hydraulic pump; a second low capacity electric motor connected to said source of electric energy with said first electric motor; a second low capacity hydraulic pump drivingly connected to said second electric motor; an hydraulic cylinder and piston; an hydraulic servo valve connected to said hydraulic cylinder, said first and second hydraulic pumps being connected in parallel to said hydraulic servo valve; an hydraulic fluid accumulator connected to said hydraulic servo valve; means for pressurizing and recirculating hydraulic fluid in said hydraulic fluid accumulator by said second hydraulic pump; a source of hydraulic fluid connected to said first hydraulic pump; a shiftable mass; said hydraulic cylinder being connected to said shiftable mass; said piston being connected to said building; means to sense vibration of said building and to generate a signal responsive thereto; means to sense vibration of said shiftable mass and to generate a signal responsive thereto; means to compare said signals and to generate signals responsive thereto to actuate said hydraulic servo valve, to actuate said accumulator, to actuate said hydraulic cylinder and piston to shift said mass, to actuate said first electric motor and said first hydraulic pump, and to actuate said pressure regulator valve to connect said first hydraulic pump to said hydraulic servo valve.

2. The apparatus of claim 1, wherein said mass is suspended from overhead anti-friction support means adapted to permit said mass to be shifted in a substantially horizontal plane.

3. The apparatus of claim 2, wherein said mass is configured to permit said hydraulic pump to be mounted at the center of gravity of said mass.

4. The apparatus of claim 3, wherein said pump is mounted on said mass at the center of gravity of said pump.

5. The apparatus of claim 4, wherein said piston is adapted to apply a thrust to said mass, the center of effort of which coincides with the center of gravity of said mass.

6. The apparatus of claim 3, wherein said mass is of U-shaped configuration.

7. The apparatus of claim 2, wherein said mass has a rectangular base and is suspended from the four corners of said base by wire rope means.

8. The apparatus of claim 7, wherein said anti-friction support means comprise four lower pulley means secured to the four corners of said rectangular base, four upper matching pulley means secured to said overhead support means, and said wire rope means interconnected between said upper and lower pulley means.

9. The apparatus of claim 7 and guide means to prevent said mass from twisting on said wire rope means.

10. The apparatus of claim 7, including shock absorber means secured to the underside of said base.

11. The apparatus of claim 6, wherein said hydraulic cylinder and piston are pivotally mounted within said U-shaped mass at the center of gravity of said hydraulic cylinder and piston, and the free end of said piston is pivotally secured to said building.

12. The apparatus of claim 1, wherein a first said apparatus is mounted in said building in a predetermined alignment relative to said building, and a second said apparatus is mounted in said building on the same plane as said first apparatus but transversely aligned to said first apparatus.

13. The apparatus of claim 12, wherein said first apparatus is mounted on the vertical center line of said building and said second apparatus is mounted proximate to a side wall of said building.

14. The apparatus of claim 1, wherein a first said apparatus is mounted in said building in a predetermined alignment relative to said building, and on the vertical center line of said building; and wherein a second said apparatus is mounted in said building on the same plane as said first apparatus and parallel thereto proximate to a side wall of said building.

15. The apparatus of claim 1, wherein a first said apparatus is mounted on an upper level of said building, and a second said apparatus is mounted on a level of said building substantially midway between said upper level and the ground level of said building.

16. The apparatus of claim 1, wherein a first said apparatus is mounted on substantially the highest level of said building, and a second said apparatus is mounted on a level of said building proximate to the node of the natural frequency of the said building.

17. The apparatus of claim 1, including a control signal generating circuit adapted to receive and to process said sensor generated signals and to generate a resultant signal; a comparator circuit adapted to receive said resultant signal; said signal generated by said shiftable mass sensor being transmitted to and processed by said comparator circuit, and said comparator circuit being adapted to generate and to transmit a signal to actuate and to control the operation of said servo valve.

18. The apparatus of claim 17, including parallel amplifying circuits adapted to amplify and to control amplification of said sensor generated signals.

19. The apparatus of claim 18, wherin said amplifying circuits are provided with phase control means to compensate for mechanical time delay of the movement of said shiftable mass relative to the sensed vibrations of said building.

20. The apparatus of claim 19, wherein said circuit for amplifying said building sensor generated signal includes an automatic gain control circuit adapted to control the level of said building sensor generated signal when said signal is compared with the said shiftable mass sensor generated signal.

21. The apparatus of claim 20, including an automatic gain control circuit adapted to control the output level of the resultant signal from said amplifying circuits.

22. The apparatus of claim 19, wherein said phase control means include an integrating circuit and a phase controller.

23. The apparatus of claim 1, wherein said accumulator is in parallel with said first and second hydraulic pumps.

24. The apparatus of claim 1, including a signal control circuit adapted to receive said sensor generated signals, to compare said signals, and to generate a signal to control said hydraulic cylinder and piston.

25. The apparatus of claim 24, including a power supply control circuit adapted to be actuated by said signal control circuit.

* * * * *